US010604341B2

(12) United States Patent
Walker

(10) Patent No.: US 10,604,341 B2
(45) Date of Patent: Mar. 31, 2020

(54) GARBAGE CONTAINER ASSEMBLY

(71) Applicant: Victor Walker, Blaine, MN (US)

(72) Inventor: Victor Walker, Blaine, MN (US)

( * ) Notice: Subject to any disclaimer, the term of this patent is extended or adjusted under 35 U.S.C. 154(b) by 0 days.

(21) Appl. No.: 16/044,649

(22) Filed: Jul. 25, 2018

(65) Prior Publication Data

US 2020/0031573 A1 Jan. 30, 2020

(51) Int. Cl.
*B65F 1/06* (2006.01)
*B65F 1/16* (2006.01)

(52) U.S. Cl.
CPC ..... *B65F 1/068* (2013.01); *B65F 1/16* (2013.01)

(58) Field of Classification Search
CPC .... H04W 48/00–16; H04B 7/00–0452; G06N 20/00–00
USPC ..... 220/495.06
See application file for complete search history.

(56) References Cited

U.S. PATENT DOCUMENTS 3,204,866 A * 9/1965 Brighton ..... B65F 1/06 232/43.2
4,923,080 A * 5/1990 Lounsbury ..... B65F 1/06 220/324
4,955,497 A 9/1990 Winden
5,901,872 A 5/1999 Zullinhofer
5,984,134 A * 11/1999 Mario ..... B65F 1/06 220/495.11
6,234,339 B1 * 5/2001 Thomas ..... B65F 1/062 220/495.07
6,732,889 B2 5/2004 Nash, Sr.
7,624,915 B2 * 12/2009 Dembowiak ..... B65F 1/1415 220/495.08
7,654,443 B1 * 2/2010 Fuller ..... B65F 1/06 220/908
D659,933 S 5/2012 Ligon
8,820,568 B1 * 9/2014 Antos ..... B65F 1/068 220/495.06
9,027,779 B2 * 5/2015 Friedman ..... B65F 1/06 220/495.11
9,944,460 B2 * 4/2018 Hon ..... B65F 1/068
2003/0006237 A1 1/2003 Passantino
2006/0283863 A1 * 12/2006 Coles ..... B65F 1/06 220/495.08
2011/0192841 A1 8/2011 Hunter

* cited by examiner

*Primary Examiner* — Kareen K Thomas

(57) ABSTRACT

A garbage container assembly for removing a garbage bag laterally from a garbage container includes a container that is positionable on a support surface. A garbage bag is removably positioned in the container for containing garbage. The container has a first section that is hingedly coupled to a second section. Moreover, the second section is positionable in an open position thereby facilitating the garbage bag to be removed from the container without lifting the garbage bag. A lid is removably positionable on the container. The lid has an access port therein to facilitate garbage to be passed therethrough for depositing the garbage in the garbage bag.

6 Claims, 4 Drawing Sheets

GARBAGE CONTAINER ASSEMBLY

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to container devices and more particularly pertains to a new container device for removing a garbage bag laterally from a garbage container.

BRIEF SUMMARY OF THE INVENTION

An embodiment of the disclosure meets the needs presented above by generally comprising a container that is positionable on a support surface. A garbage bag is removably positioned in the container for containing garbage. The container has a first section that is hingedly coupled to a second section. Moreover, the second section is positionable in an open position thereby facilitating the garbage bag to be removed from the container without lifting the garbage bag. A lid is removably positionable on the container. The lid has an access port therein to facilitate garbage to be passed therethrough for depositing the garbage in the garbage bag.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
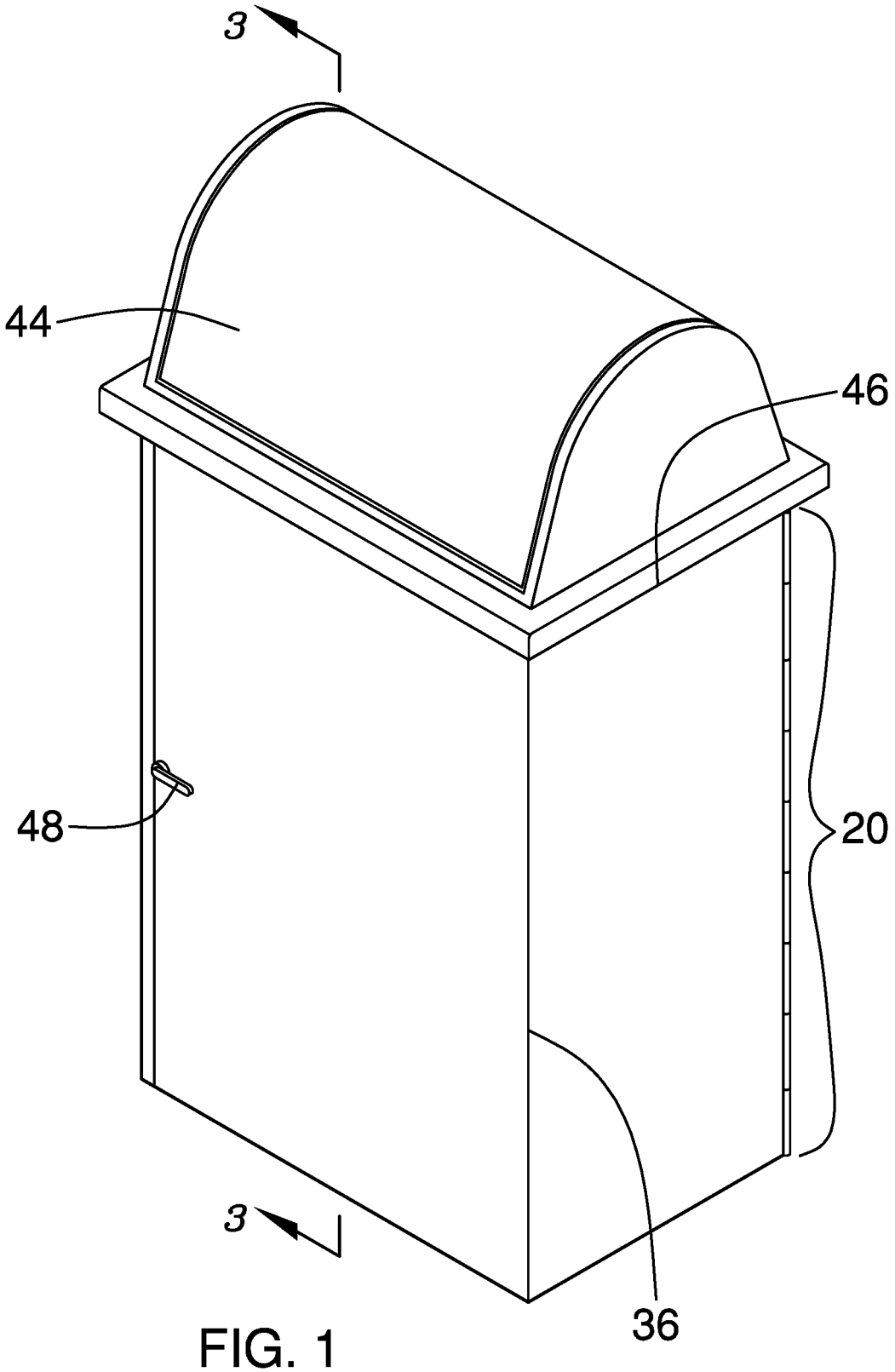
FIG. 1 is a top perspective view of a garbage container assembly according to an embodiment of the disclosure.
Figure 2:
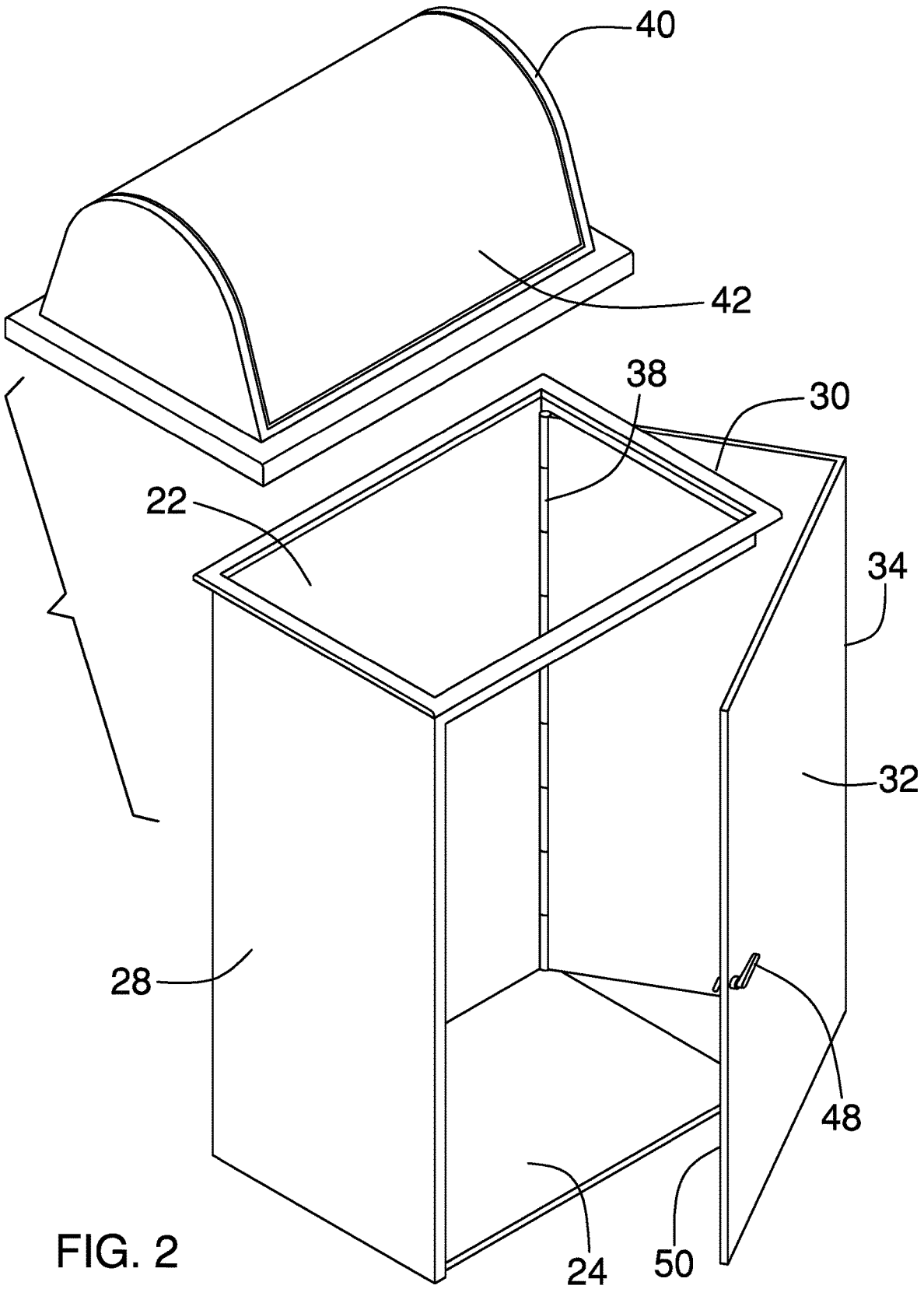
FIG. 2 is an exploded perspective view of an embodiment of the disclosure.
Figure 3:
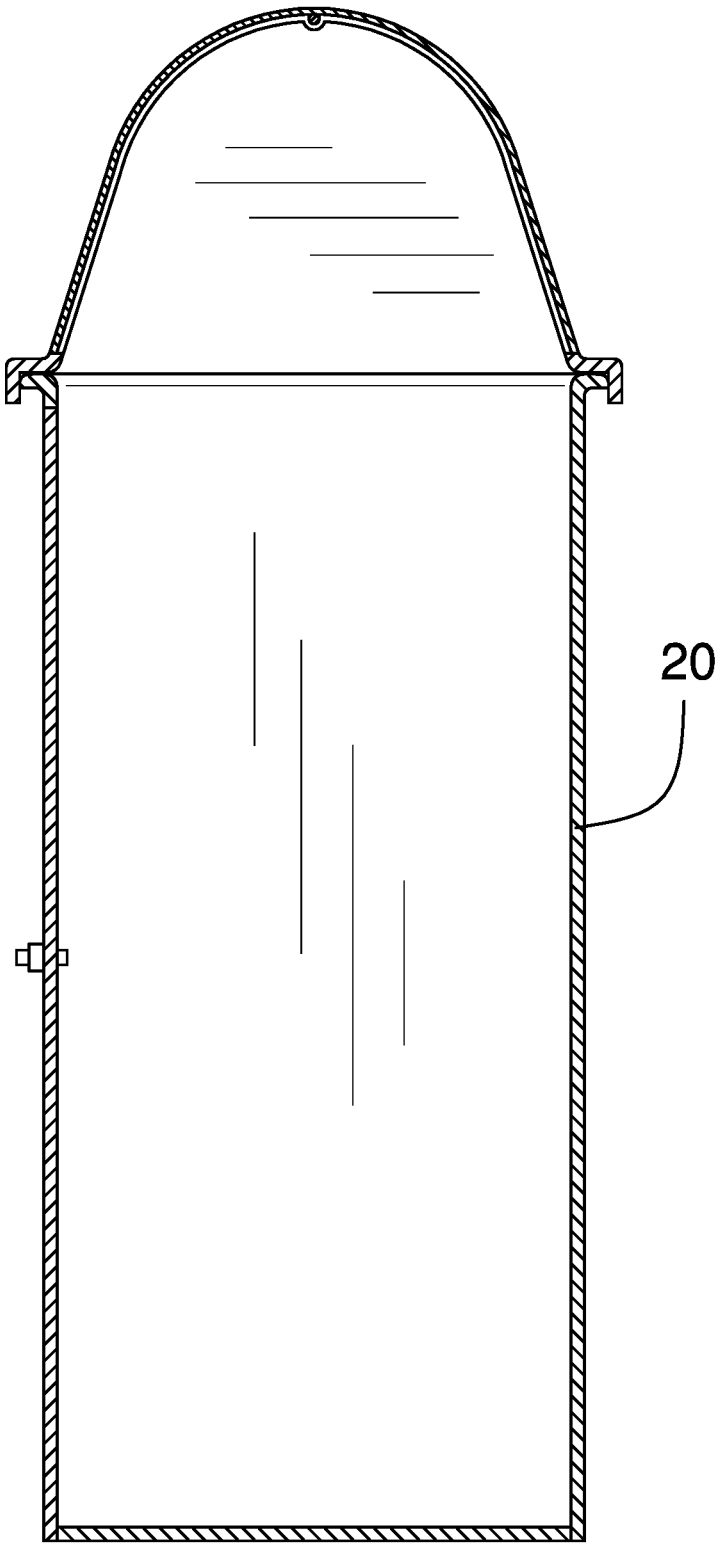
FIG. 3 is a cross sectional view taken along line 3-3 of FIG. 1 of an embodiment of the disclosure.
Figure 4:
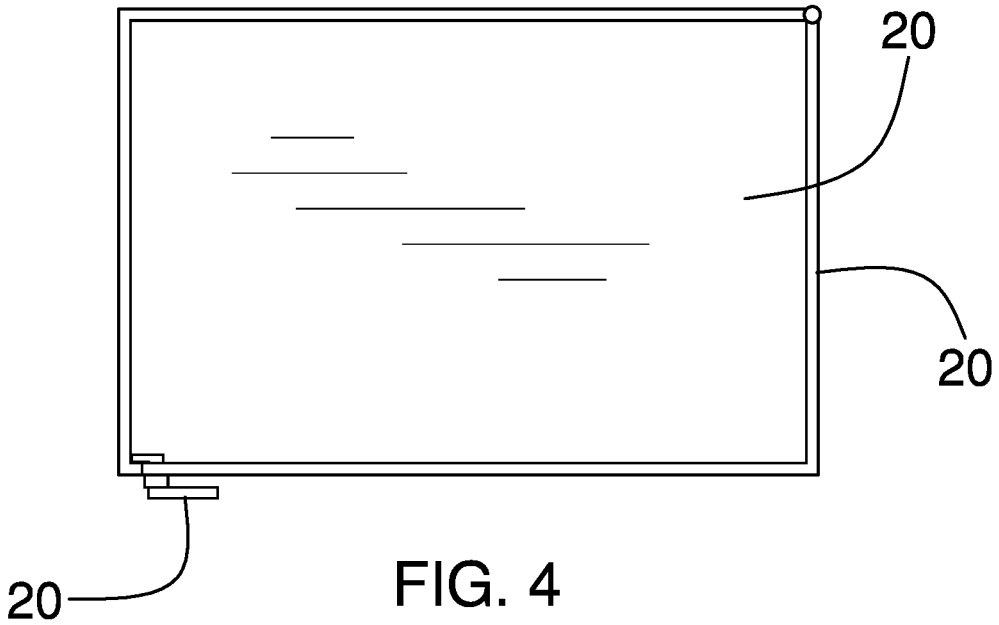
FIG. 4 is a bottom view of an embodiment of the disclosure showing a second section in a closed position.
Figure 5:
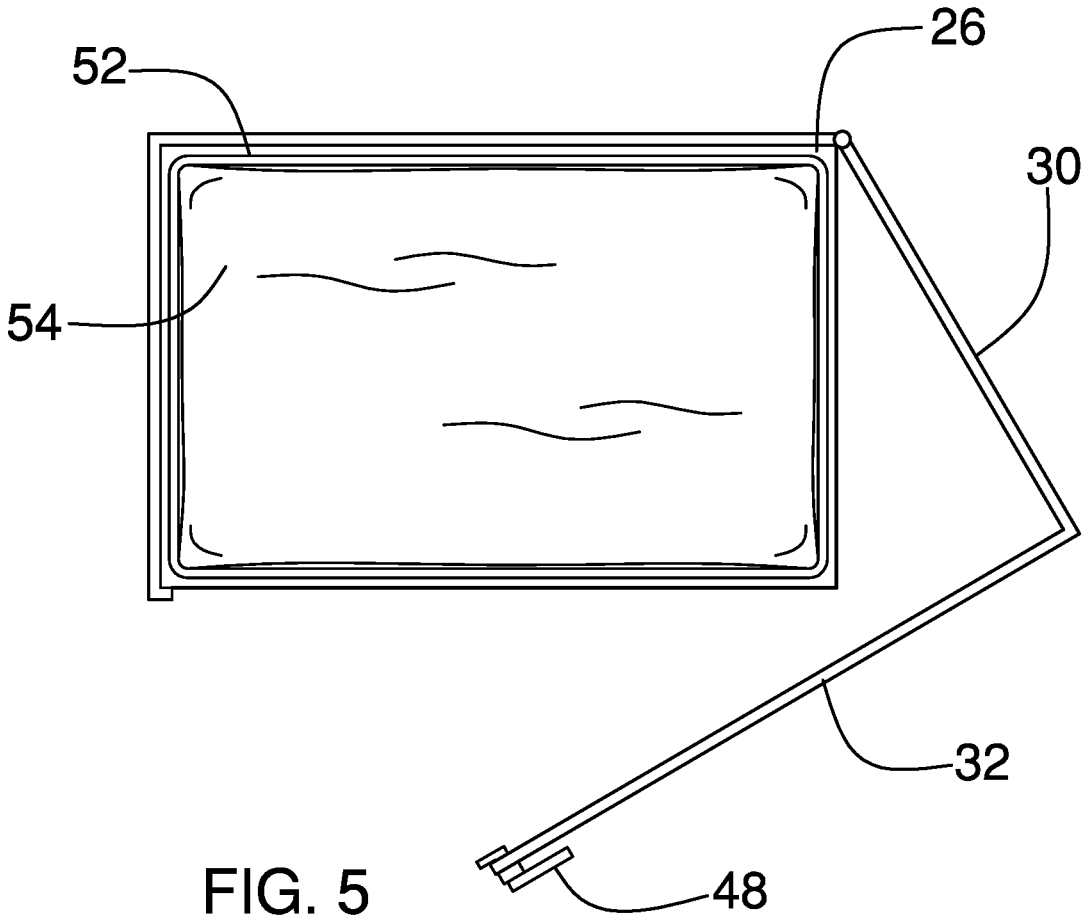
FIG. 5 is a bottom view of an embodiment of the disclosure showing a second section being opened.

With reference now to the drawings, and in particular to FIGS. 1 through 5 thereof, a new container device embodying the principles and concepts of an embodiment of the disclosure and generally designated by the reference numeral 10 will be described.

As best illustrated in FIGS. 1 through 5, the garbage container assembly 10 generally comprises a container 12 that is positionable on a support surface 14, such as a floor or the like. A garbage bag 16 is removably positioned in the container 12 for containing garbage. The container 12 has a first section 18 that is hingedly coupled to a second section 20. Moreover, the second section 20 is positionable in an open position thereby facilitating the garbage bag 16 to be removed from the container 12 without lifting the garbage bag 16.

The container 12 has a basal wall 22 and the first section 18 comprises a first panel 24 forming an angle with a second panel 26. Each of the first 24 and second 26 panels has a bottom edge 28, a top edge 30 and a first lateral edge 32, and the bottom edge 28 of each of the first 24 and second 26 panels is coupled to the basal wall 22 having each of the first 24 and second 26 panels extending upwardly from the basal wall 22. Each of the first 24 and second 26 panels is aligned with an outside edge 33 of the basal wall 22.

The second section 20 of the container 12 comprises a primary panel 34 forming an angle with a secondary panel 36, and each of the primary 34 and secondary 36 panels has an upper edge 38 and a first lateral edge 40. The first lateral edge 40 of the primary panel 34 is hingedly coupled to the first lateral edge 32 of the second panel 26. The secondary panel 36 extends between the primary panel 34 and the first panel 24 when the second section 20 is positioned in a closed position such that the container 12 forms a cubic shape. Each of the primary 34 and secondary 36 panels is spaced from the outside edge 33 of the basal wall 22 when the second section 20 is positioned in the open position for accessing an interior of the container 12. Moreover, the second section 20 is spaced from the garbage bag 16 when the second section 20 is in the open position thereby facilitating air to pass between the garbage bag 16 and the second section 20. In this way vacuum pressure does not form between the garbage bag 16 and the container 12 that can potentially inhibit the garbage bag 16 from being removed from the container 12.

A lip 41 is coupled to and extends laterally away from the first panel 24, and the lip 41 is aligned with and is coextensive with the first lateral edge 32 of the first panel 24. A lock 42 is rotatably coupled to the secondary panel 36. The lock 42 engages the lip 41 when the second section 20 is closed and the lock 42 is manipulated into a locking position. Additionally, the lock 42 disengages the lip 41 when the lock 42 is manipulated into an unlocked position. The lock 42 may be a mechanical door lock of any conventional design.

A lid 44 is provided and the lid 44 is removably positionable on the container 12. The lid 44 has an access port 46 therein and the access port 46 facilitates garbage to be passed therethrough for depositing the garbage in the garbage bag 16. The lid 44 has a top wall 48 and an outer wall 50 extending downwardly therefrom. The outer wall 50 has a forward side 52 and the forward side 52 is open to define the access port 46. The outer wall 50 angles outwardly from the top wall 48 such that the lid 44 has a trapezoidal shape.

The outer wall 50 has a distal edge 54 with respect to the top wall 46, and the distal edge 54 abuts the top edge 30 of the first 24 and second 26 panels and the upper edge 38 of the secondary panel 36 when the lid 44 is positioned on the container 12. A wall 56 is coupled to and extends downwardly from the distal edge 54 of the outer wall 50 of the lid 44. The wall 56 engages each of the first 24, second 26 and secondary 36 panels when the lid 44 is positioned on the container 12 thereby inhibiting the lid 44 from sliding off of the container 12.

In use, the second section 20 is positioned in the closed position, the garbage bag 16 is positioned in the container 12 and the lid 44 is positioned on the container 12. Garbage is passed through the access port 46 in the lid 44 to position the garbage in the garbage bag 16. The second section 20 is opened when the garbage bag 16 is full and needs to be removed from the container 12. Thus, the garbage bag 16 can be removed laterally from the container 12 as opposed to being vertically removed from the container 12. In this way a physically limited person can remove the garbage bag 16 without being required to lift the garbage bag 16. Moreover, opening the second section 20 inhibits vacuum pressure from forming between the garbage bag 16 and the container 12 thereby enhancing removing the garbage bag 16 from the container 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A garbage container assembly having a door thereon for removing a garbage bag from said assembly, said assembly comprising:

a container being positionable on a support surface, said container having a garbage bag being removably positioned therein for containing garbage, said container having a first section being hingedly coupled to a second section, said second section being positionable in an open position thereby facilitating the garbage bag to be removed from said container without lifting the garbage bag, said container having a basal wall, said first section comprising a first panel forming an angle with a second panel, each of said first and second panels having a bottom edge, a top edge and a first lateral edge, said bottom edge of each of said first and second panels being coupled to said basal wall having each of said first and second panels extending upwardly from said basal wall, each of said first and second panels being aligned with an outside edge of said basal wall, said second section comprising a primary panel forming an angle with a secondary panel, each of said primary and secondary panels having an upper edge and a first lateral edge, said first lateral edge of said primary panel being hingedly coupled to said first lateral edge of said second panel; and a lid being removably positionable on said container, said lid having an access port therein wherein said access port is configured to facilitate garbage to be passed therethrough for depositing the garbage in the garbage bag, said lid having a top wall and an outer wall extending downwardly therefrom, said outer wall having a forward side, said forward side being open to define said access port, said outer wall angling outwardly from said top wall such that said lid has a trapezoidal shape, said outer wall having a distal edge with respect to said top wall, said distal edge abutting said top edge of said first and second panels and said upper edge of said secondary panel when said lid is positioned on said container.

2. The assembly according to claim 1, wherein:

said secondary panel extends between said primary panel and said first panel when said second section is positioned in a closed position such that said container forms a cubic shape; and said each of said primary end secondary panels being spaced from said outside edge of said basal wall when said second section is positioned in said open position for accessing an interior of said container, said second section being spaced from the garbage bag when said second section is in said open position thereby facilitating air to pass between the garbage bag and said second section wherein said second section is configured to inhibit vacuum pressure from inhibiting the garbage bag from being removed from said container.

3. The assembly according to claim 2, further comprising a lip being coupled to and extending laterally away from said first panel, said lip being aligned with and being coextensive with said first lateral edge of said first panel.

4. The assembly according to claim 1, further comprising a wall being coupled to and extending downwardly from said distal edge of said lid, said wall engaging each of said first, second and secondary panels when said lid is positioned on said container thereby inhibiting said lid from sliding off of said container.

5. A garbage container assembly having a door thereon for removing a garbage bag from said assembly, said assembly comprising:

a container being positionable on a support surface, said container having a garbage bag being removably positioned therein for containing garbage, said container having a first section being hingedly coupled to a second section, said second section being positionable in an open position thereby facilitating the garbage bag to be removed from said container without lifting the garbage bag, said container having a basal wall, said first section comprising a first panel forming an angle with a second panel, each of said first and second panels having a bottom edge, a top edge and a first lateral edge, said bottom edge of each of said first and second panels being coupled to said basal wall having each of said first and second panels extending upwardly from said basal wall, each of said first and second panels being aligned with an outside edge of said basal wall, said second section comprising a primary panel forming an angle with a secondary panel, each of said primary and secondary panels having an upper edge and a first lateral edge, said first lateral edge of said primary panel being hingedly coupled to said first lateral edge of said second panel, said secondary panel extends between said primary panel and said first panel when said second section is positioned in a closed position such that said container forms a cubic shape, each of said primary and secondary panels being spaced from said outside edge of said basal wall when said second section is positioned in said open position for accessing an interior of said container, said second section being spaced from the garbage bag when said second section is in said open position thereby facilitating air to pass between the garbage bag and said second section wherein said second section is configured to inhibit vacuum pressure from inhibiting the garbage bag from being removed from said container; and a lid being removably positionable on said container, said lid having an access port therein wherein said access port is configured to facilitate garbage to be passed therethrough for depositing the garbage in the garbage bag;

a lip being coupled to and extending laterally away from said first panel, said lip being aligned with and being coextensive with said first lateral edge of said first panel; and a lock being rotatably coupled to said secondary panel, said lock engaging said lip when said second section is closed and said lock is manipulated into an locking position, said lock disengaging said lip when said lock is manipulated into an unlocked position.

6. A garbage container assembly having a door thereon for removing a garbage bag from said assembly, said assembly comprising:

a container being positionable on a support surface, said container having a garbage bag being removably positioned therein for containing garbage, said container having a first section being hingedly coupled to a second section, said second section being positionable in an open position thereby facilitating the garbage bag to be removed from said container without lifting the garbage bag, said container having a basal wall, said first section comprising a first panel forming an angle with a second panel, each of said first and second panels having a bottom edge, a top edge and a first lateral edge, said bottom edge of each of said first and second panels being coupled to said basal wall having each of said first and second panels extending upwardly from said basal wall, each of said first and second panels being aligned with an outside edge of said basal wall, said second section comprising a primary panel forming an angle with a secondary panel, each of said primary and secondary panels having an upper edge and a first lateral edge, said first lateral edge of said primary panel being hingedly coupled to said first lateral edge of said second panel, said secondary panel extending between said primary panel and said first panel when said second section is positioned in a closed position such that said container forms a cubic shape, said each of said primary end secondary panels being spaced from said outside edge of said basal wall when said second section is positioned in said open position for accessing an interior of said container, said second section being spaced from the garbage bag when said second section is in said open position thereby facilitating air to pass between the garbage bag and said second section wherein said second section is configured to inhibit vacuum pressure from inhibiting the garbage bag from being removed from said container;

a lip being coupled to and extending laterally away from said first panel, said lip being aligned with and being coextensive with said first lateral edge of said first panel;

a lock being rotatably coupled to said secondary panel, said lock engaging said lip when said second section is closed and said lock is manipulated into an locking position, said lock disengaging said lip when said lock is manipulated into an unlocked position;

a lid being removably positionable on said container, said lid having an access port therein wherein said access port is configured to facilitate garbage to be passed therethrough for depositing the garbage in the garbage bag, said lid having a top wall and an outer wall extending downwardly therefrom, said outer wall having a forward side, said forward side being open to define said access port, said outer wall angling outwardly from said top wall such that said lid has a trapezoidal shape, said outer wall having a distal edge with respect to said top wall, said distal edge abutting said top edge of said first and second panels and said upper edge of said secondary panel when said lid is positioned on said container; and a wall being coupled to and extending downwardly from said distal edge of said lid, said wall engaging each of said first, second and secondary panels when said lid is positioned on said container thereby inhibiting said lid from sliding off of said container.

* * * * *